US010267074B2

(12) United States Patent
Liu et al.

(10) Patent No.: US 10,267,074 B2
(45) Date of Patent: Apr. 23, 2019

(54) ECCENTRIC HINGE

(71) Applicant: Zengbang Li, Shenzhen (CN)

(72) Inventors: Zhiguo Liu, Shenzhen (CN); Feng Li, Shenzhen (CN)

(73) Assignee: Zengbang Li (CN)

( * ) Notice: Subject to any disclaimer, the term of this patent is extended or adjusted under 35 U.S.C. 154(b) by 0 days.

(21) Appl. No.: 15/673,490

(22) Filed: Aug. 10, 2017

(65) Prior Publication Data

US 2017/0335612 A1 Nov. 23, 2017

Related U.S. Application Data

(63) Continuation-in-part of application No. PCT/CN2015/078642, filed on May 11, 2015.

(30) Foreign Application Priority Data

Feb. 10, 2015 (CN) ..... 2015 2 0092985 U

(51) Int. Cl.

| | |
|---|---|
| ***E05D 3/18*** | (2006.01) |
| ***E05D 7/04*** | (2006.01) |
| ***E05D 3/16*** | (2006.01) |
| ***E05D 15/30*** | (2006.01) |
| ***E05D 15/58*** | (2006.01) |

(52) U.S. Cl.

CPC ..... *E05D 3/18* (2013.01); *E05D 3/16* (2013.01); *E05D 7/04* (2013.01); *E05D 15/30* (2013.01);

(Continued)

(58) Field of Classification Search

CPC .... E05D 3/00; E05D 3/06; E05D 3/12; E05D 3/125; E05D 3/127; E05D 3/16;

(Continued)

(56) References Cited

U.S. PATENT DOCUMENTS 5,081,743 A * 1/1992 Mayes ..... E05D 15/44 16/341
5,898,977 A * 5/1999 Muir ..... E05D 15/44 16/341

(Continued)

FOREIGN PATENT DOCUMENTS

CN 2697250 5/2005
CN 2839504 11/2006

(Continued)

OTHER PUBLICATIONS

Patent Cooperation Treaty (PCT), International Search Report and Written Opinion for Application PCT/CN2015/078642 filed May 11, 2015, dated Nov. 19, 2015, International Searching Authority, CN.

*Primary Examiner* — Roberta S Delisle
(74) *Attorney, Agent, or Firm* — McDonald Hopkins LLC

(57) ABSTRACT

An eccentric hinge includes a rail, a stop block arranged on a first end of the rail, a fixing rod parallel with the rail, a sliding block, a connecting rod and a transmission rod, where the sliding block is arranged on the rail; a first end of the connecting rod is connected with a second end of the rail; a second end of the connecting rod is connected with the fixing rod; a first end of the transmission rod is connected with the sliding bock; a second end of the transmission rod is connected with the connecting rod; when the eccentric hinge is in a closed state, a first centerline of the fixing rod and a second centerline of the rail are parallel lines in a same plane; and a distance between the parallel lines is greater than 0 mm and less than or equal to 10 mm.

10 Claims, 4 Drawing Sheets

(52) U.S. Cl.
CPC ..... *E05D 15/581* (2013.01); *E05D 2003/166* (2013.01); *E05D 2015/586* (2013.01); *E05D 2700/00* (2013.01); *E05Y 2201/626* (2013.01); *E05Y 2600/45* (2013.01); *E05Y 2900/148* (2013.01)

(58) Field of Classification Search
CPC .. E05D 3/18; E05D 7/04; E05D 15/10; E05D 15/1005; E05D 15/1013; E05D 15/30; E05D 15/581
USPC ..... 16/366, 368–369
See application file for complete search history.

(56) References Cited

U.S. PATENT DOCUMENTS 6,434,887 B2 * 8/2002 Nakanishi ..... E05D 15/30 49/246
6,928,697 B2 * 8/2005 Brain ..... E05D 15/30 16/193
7,024,728 B2 * 4/2006 Muir ..... E05D 15/44 16/221
7,047,600 B2 * 5/2006 Muir ..... E05D 15/30 16/346
7,096,539 B2 * 8/2006 Muir ..... E05D 15/30 16/247
7,690,154 B2 * 4/2010 Muir ..... E05D 15/44 49/246
8,230,644 B2 * 7/2012 Lambertini ..... E05D 7/0415 49/246
8,769,873 B2 * 7/2014 Feng ..... E05C 17/28 49/246

FOREIGN PATENT DOCUMENTS

| | | |
|---|---|---|
| CN | 202324931 | 7/2012 |
| CN | 103410393 | 11/2013 |
| CN | 203769516 | 8/2014 |
| GB | 2313403 | 11/1997 |

* cited by examiner

ECCENTRIC HINGE

CROSS-REFERENCES TO RELATED APPLICATIONS

The present application is a continuation-in-part of international application No. PCT/CN2015/078642, filed on May 11, 2015, which claims the priority from Chinese patent application No. 201520092985.5, filed on Feb. 10, 2015; and the disclosures of the above applications are hereby incorporated by reference.

TECHNICAL FIELD

The present disclosure relates to the technical field of door and window hinges, and for example, relates to an eccentric hinge.

BACKGROUND

In a related art, a hinge used on a window frame and a window sash can be designed in such a manner that a fixing rod and a rail are vertically aligned. Namely, when the hinge is in a closed state, a first centerline of the fixing rod and a second centerline of the rail are mutually overlapped. Through such structural design, processing of the hinge is convenient to control, since materials of the window frame and the window sash in the related art are mostly formed by extrusion of aluminum alloy (the extrusion is a plastic processing method for applying strong pressure on metal blanks placed in a mold cavity (or an extrusion cylinder) to force the metal blanks to produce directional plastic deformation for extruding the metal blanks from mold holes of an extrusion mold to obtain a part or semi-finished product having required section shape and size and certain mechanical property). According to a design standard for door notch and window notch, to reduce an installation error between the window sash and the window frame, a width of the notch in the window frame is different from a width of the notch in the window sash, a side of the notch in a window frame is aligned with a side of the notch in a window sash, and a centerline of the notch in a window frame and a centerline of the notch in a window sash are not in line. When a first centerline of the fixing rod and a second centerline of the fixing rod installation groove in the hinge are not in line, installation precision between the window frame and the window sash may be influenced.

SUMMARY

An eccentric hinge includes a rail, a stop block arranged on a first end of the rail, a fixing rod parallel with the rail, a sliding block, a connecting rod and a transmission rod, wherein the sliding block is arranged on the rail; a first end of the connecting rod is connected with a second end of the rail; a second end of the connecting rod is connected with the fixing rod; a first end of the transmission rod is connected with the sliding bock; and a second end of the transmission rod is connected with the connecting rod; when the eccentric hinge is in a closed state, a first centerline of the fixing rod and a second centerline of the rail are parallel lines in a same plane; and a distance between the parallel lines is greater than 0 mm and less than or equal to 10 mm.

Figure 1:
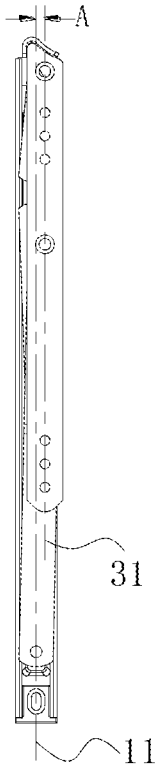
FIG. 1 is a structural schematic diagram illustrating an eccentric hinge in a closed state provided in an embodiment.

In the figures: 1. rail; 11. second centerline

2. stop block

3. fixing rod; 31. first centerline; 32. first bending segment; 33. second bending segment

4. window sash

5. window frame

61. adjusting block; 62. first groove penetrating piece; 63. second groove penetrating piece; 64. adjusting screw; 65. set screw

7. bearing block; 71. connecting piece; 711. first connecting piece; 7111. groove; 712. second connecting piece; 713. adjusting piece; 72. fixing piece; 721. first installation hole; 722. second installation hole; 73. fastener

8. sliding block; 9. connecting rod; 10. transmission rod.

DETAILED DESCRIPTION

As shown in FIG. 1, an eccentric hinge includes a rail 1, a stop block 2 arranged on a first end of the rail 1, and a fixing rod 3 parallel with the rail 1 and arranged above the rail 1. As shown in FIG. 1, when the eccentric hinge is in a closed state, a first centerline 31 of the fixing rod 3 and a second centerline 11 of the rail 1 are parallel lines in a same plane. A distance (A) between the parallel lines is greater than 0 mm and less than or equal to 10 mm (i.e., $0<A\leq 10$ mm). Optionally, the A is 5 mm, so that the fixing rod can be smoothly inserted into a fixing rod installation groove of a window sash. Optionally, to keep the shifted fixing rod and the sliding rod 1 horizontally, the stop block 2 is designed into a V shape and the stop block 2 can be used to stop one end of the fixing rod.

Figure 2:
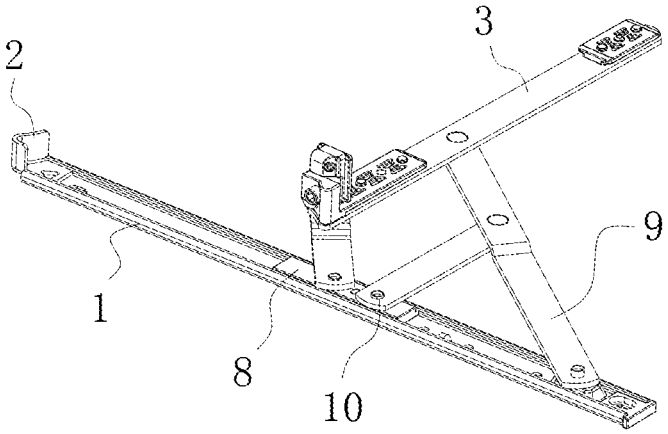
FIG. 2 is a structural schematic diagram 1 illustrating an eccentric hinge in an unfolded state provided in an embodiment.
Figure 3:
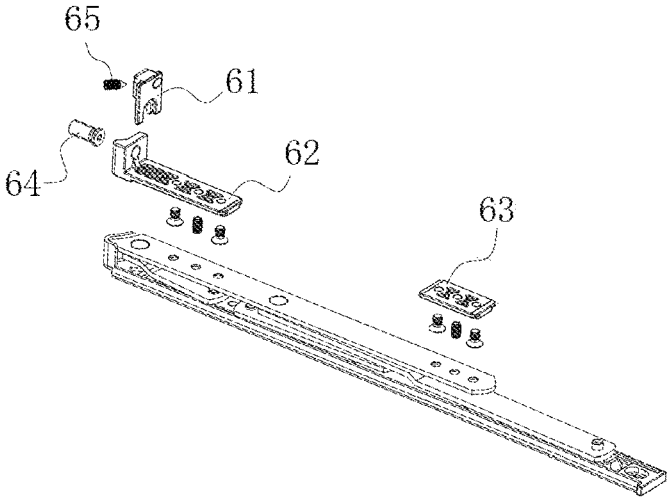
FIG. 3 is an exploded structural schematic diagram illustrating an adjusting assembly in FIG. 2.
Figure 4:
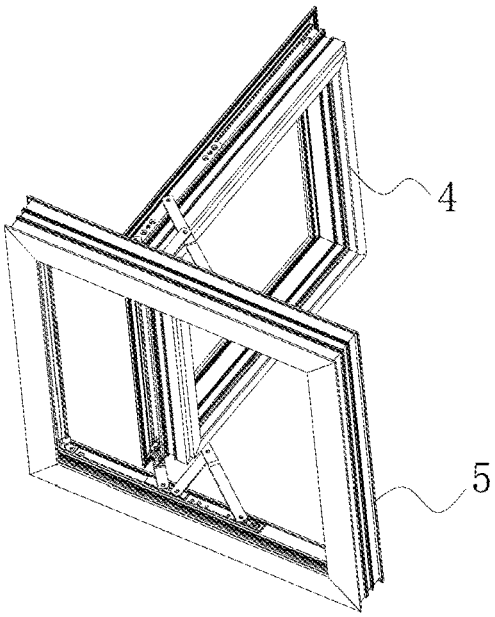
FIG. 4 is a structural schematic diagram illustrating installing eccentric hinges to a window sash and a window frame of FIG. 2.

Optionally, as shown in FIG. 2, FIG. 3 and FIG. 4, the eccentric hinge further includes an adjusting assembly arranged on the fixing rod 3, where the adjusting assembly adjusts a gap between the window sash 4 and the window frame 5.

Optionally, the adjusting assembly includes an adjusting block 61, a first groove penetrating piece 62 secured to a first end of the fixing rod 3, a second groove penetrating piece 63 secured to a second end of the fixing rod 3, and an adjusting screw 64 configured to secured the adjusting block 61 to a vertical wall at one end of the first groove penetrating piece 62. The clamping groove is perpendicular to one side of the window sash 4. The adjusting block 61 clamps in a clamping groove at one side of the window sash 4.

Optionally, as shown in FIG. 3, an upper end of the adjusting block 61 is provided with a fixing head. The fixing head is provided with set screw 65 configured to secure the adjusting block 61. The set screw 65 obliquely passes through the fixing head. Optionally, the first groove penetrating piece 62 and the second groove penetrating piece 63 respectively passes through a notch in a C-shaped fixing groove (fixing rod installation groove) in the window sash 4. The C-shaped fixing groove is a long notch in the window sash. Through above structural design, by adjusting a distance between the adjusting block 61 and the adjusting screw 64 in the adjusting assembly, a distance between the window sash and the window frame along an axis of the adjusting screw 64 can be flexibly adjusted and installation of the eccentric hinge is facilitated.

Figure 5:
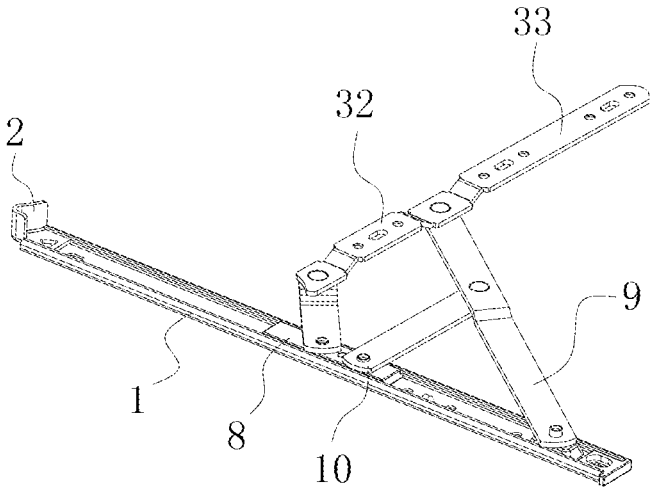
FIG. 5 is a structural schematic diagram illustrating an eccentric hinge provided in an embodiment when a fixing rod is bent.

Optionally, as shown in FIG. 5, the fixing rod 3 includes a first bending segment 32 and a second bending segment 33. The first bending segment 32 and the second bending segment 33 are provided with through holes for securing the window sash 4 and the fixing rod 3. The first groove penetrating piece 62 and the second groove penetrating piece 63 in the above installation mode can be replaced by the design in FIG. 5 which facilitates installation of the fixing rod and the fixing rod installation groove in the window sash and facilitates installation of the eccentric hinge.

Figure 6:
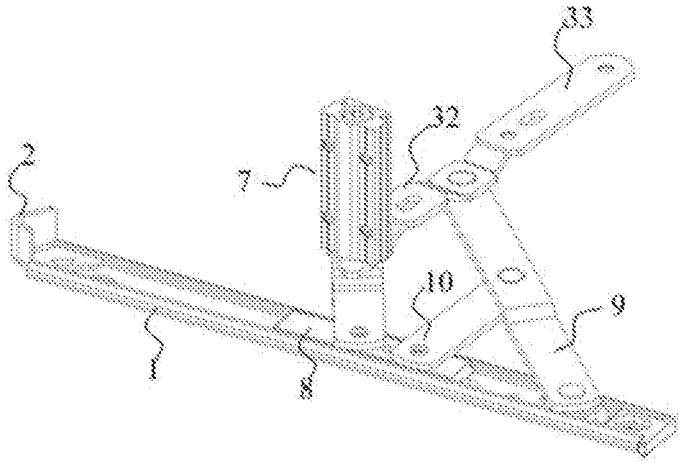
FIG. 6 is a structural schematic diagram 2 illustrating an eccentric hinge in an unfolded state provided in an embodiment.
Figure 7:
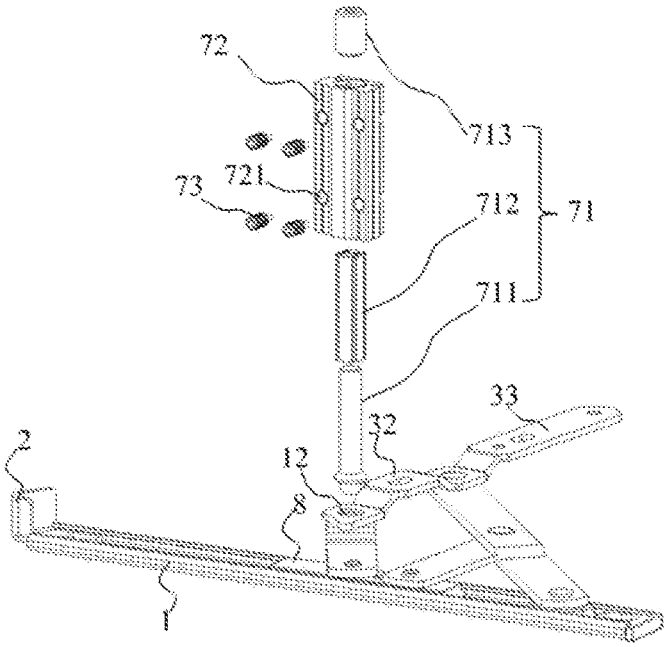
FIG. 7 is a structural schematic diagram 3 illustrating an eccentric hinge in an unfolded state provided in an embodiment.

Optionally, based on an optional solution in FIG. 5, as shown in FIG. 6 and FIG. 7, the eccentric hinge further includes a bearing block 7 and a bearing installation hole 12, where the bearing block 7 is fixed to one end, which is close to the first bending segment 32, of the fixing rod 3 through the bearing installation hole 12.

Optionally, the bearing block 7 includes a connecting piece 71, a fixing piece 72 and a fastener 73. One end, which is close to the first bending segment 32, of the connecting piece 71 is connected with the bearing installation hole 12. The connecting piece 71 is arranged inside the fixing piece 72. The fastener 73 is configured to fix the fixing piece 72 in the C-shaped fixing groove of the window sash 4. The fixing piece 72 can be installed in the notch in the C-shaped fixing groove in the window sash 4.

Optionally, a side of the fixing piece 72 is provided with a first installation hole 721. The fastener 73 enters the first installation hole 721 and secure the fixing piece 72 to the window sash 4. A number of the fastener 73 and a number of the first installation hole 721 may be identical. The number of the fastener 73 may be greater than or equal to 1.

As shown in FIG. 7, the number of the fasteners 73 may be an integral multiple of 2, the fasteners 73 are arranged on a side of the fixing piece, and the fasteners 73 are symmetrical about a central axis of the side of fixing piece. The fasteners 73 may be screws and threads may be arranged on a side of the first installation hole 721.

Optionally, the connecting piece 71 includes a first connecting piece 711, a second connecting piece 712 and a adjusting piece 713. One end, which is close to the first bending segment 32, of the first connecting piece 711 is connected with the bearing installation hole 12. The first connecting piece 711 is arranged inside the second connecting piece 712. The adjusting piece 713 abuts against the second connecting piece 712.

Optionally, as shown in FIG. 7, the adjusting piece 713 is installed on one end, which is away from the bearing installation hole 12, of the fixing piece 72, and enters a top end of the fixing piece 72 to abut against the second connecting piece 712. The connecting piece 71 can be arranged inside a central of the fixing piece 72. The adjusting piece 713 may be a screw. Threads are arranged on an inner wall of a through hole for accommodating the adjusting piece 713 at the central axis of the fixing piece 72. The adjusting piece 713 can pass through the through hole with the threads in the fixing piece 72 to abut against the second connecting piece 712.

The fixing piece 72 is fixed to the window sash 4, while the connecting piece 71 is fixed to the hinge. The hinge is fixed to the window frame 5. An extension direction of a gap between the window sash 4 and the window frame 5 is perpendicular to a direction of the fixing rod 3, and the gap can be regulated through the adjusting screw (adjusting piece 713), thereby realizing relative movement between the window frame and the window sash.

As shown in FIG. 7, the first connecting piece 711 may be a rotating shaft. The first connecting piece 711 can be arranged inside the second connecting piece 712 through matching of a hole and a shaft. The connecting piece 71 is arranged inside the fixing piece 72. The second connecting piece 712 can be made of wear-resisting plastics. A frictional coefficient between the first connecting piece and the second connecting piece can be reduced in such a manner that the hole and the shaft of different materials are matched, thereby prolonging service life of the connecting piece.

The bearing block 7 shown in FIG. 7 can be arranged on the eccentric hinge installed at lower parts of the window sash 4 and the window frame 5 in FIG. 4.

Figure 8:
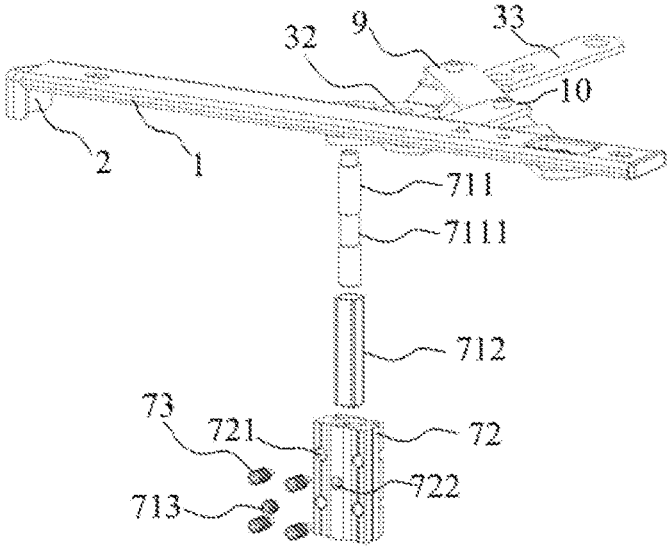
FIG. 8 is a structural schematic diagram 4 illustrating an eccentric hinge in an unfolded state provided in an embodiment.

Optionally, as shown in FIG. 8, the adjusting piece 713 is installed on a side of the fixing piece 72. The adjusting piece 713 passes through the side of the fixing piece 72 to abut against the second connecting piece 712.

Optionally, the connecting piece 71 is arranged inside the central of the fixing piece 72. The adjusting piece 713 is a screw. The side of the fixing piece 72 is provided with a second installation hole 722. The adjusting piece 713 can abut against the second connecting piece 712 through the second installation hole 722.

Optionally, as shown in FIG. 8, a groove 7111 is formed in a middle part of the first connection piece 711.

The bearing block 7 shown in FIG. 8 can be arranged on the eccentric hinge installed at upper parts of the window sash 4 and the window frame 5 in FIG. 4.

Optionally, the eccentric hinge further includes a sliding block 8, a connecting rod 9 and a transmission rod 10, where the sliding block 8 is arranged on the rail 1; a first end of the connecting rod 9 is connected with a second end of the rail 1; a second end of the connecting rod 9 is connected with the fixing rod 3; a first end of the transmission rod 10 is connected with the sliding bock 8; and a second end of the transmission rod 10 is connected with the connecting rod 9, so as to form a multi-rod linkage eccentric hinge.

What is claimed is:

1. An eccentric hinge, comprising a rail, a stop block arranged on a first end of the rail, a fixing rod parallel with the rail, a sliding block, a connecting rod, a transmission rod and an adjusting assembly, wherein the sliding block is arranged on the rail; a first end of the connecting rod is connected with a second end of the rail; a second end of the connecting rod is connected with the fixing rod; a first end of the transmission rod is connected with the sliding bock; a second end of the transmission rod is connected with the connecting rod; when the eccentric hinge is in a closed state, a first centerline of the fixing rod and a second centerline of the rail are parallel lines in a same plane; a distance between the parallel lines is greater than 0 mm and less than or equal to 10 mm; and the adjusting assembly is arranged on the fixing rod and configured to adjust a gap between a window sash and a window frame; wherein the adjusting assembly comprises an adjusting block, a first groove penetrating piece fastened with a first end of the fixing rod, a second groove penetrating piece fastened with a second end of the fixing rod, and a regulating screw configured to secure the adjusting block to a vertical wall at one end of the first groove penetrating piece.

2. The eccentric hinge according to claim 1, wherein an end of the adjusting block is provided with a fixing head; the fixing head is provided with a set screw configured to secure the adjusting block; and the set screw obliquely passes through the fixing head.

3. An eccentric hinge, comprising a rail, a stop block arranged on a first end of the rail, a fixing rod parallel with the rail, a sliding block, a connecting rod, a transmission rod and a bearing block and a bearing installation hole, wherein the sliding block is arranged on the rail; a first end of the connecting rod is connected with a second end of the rail; a second end of the connecting rod is connected with the fixing rod; a first end of the transmission rod is connected with the sliding bock; a second end of the transmission rod is connected with the connecting rod; when the eccentric hinge is in a closed state, a first centerline of the fixing rod and a second centerline of the rail are parallel lines in a same plane; and a distance between the parallel lines is greater than 0 mm and less than or equal to 10 mm; wherein the bearing block is fixed to one end, which is close to the first bending segment, of the fixing rod through the bearing installation hole.

4. The eccentric hinge according to claim 3, wherein the bearing block comprises a connecting piece, a fixing piece and a fastener; one end, which is close to the first bending segment, of the connecting piece is connected with the bearing installation hole; the connecting piece is arranged inside the fixing piece; and the fastener is configured to fix the fixing piece to the window sash.

5. The eccentric hinge according to claim 4, wherein the connecting piece comprises a first connecting piece, a second connecting piece and an adjusting piece; one end, which is close to the first bending segment, of the first connecting piece is connected with the bearing installation hole; the first connecting piece is arranged inside the second connecting piece; and the adjusting piece abuts against the second connecting piece.

6. The eccentric hinge according to claim 5, wherein the adjusting piece is installed on one end of the fixing piece away from the bearing installation hole, and the adjusting piece enters a top end of the fixing piece to abut against the second connecting piece.

7. The eccentric hinge according to claim 5, wherein the adjusting piece is installed on a side of the fixing piece; and the adjusting piece passes through the side of the fixing piece to abut against the second connecting piece.

8. An eccentric hinge, comprising a rail, a stop block arranged on a first end of the rail, a fixing rod parallel with the rail, a sliding block, a connecting rod and a transmission rod, wherein the sliding block is arranged on the rail; a first end of the connecting rod is connected with a second end of the rail; a second end of the connecting rod is connected with the fixing rod; a first end of the transmission rod is connected with the sliding bock; a second end of the transmission rod is connected with the connecting rod; when the eccentric hinge is in a closed state, a first centerline of the fixing rod and a second centerline of the rail are parallel lines in a same plane; and a distance between the parallel lines is greater than 0 mm and less than or equal to 10 mm.

9. The eccentric hinge according to claim 8, further comprising an adjusting assembly arranged on the fixing rod and configured to adjust a gap between a window sash and a window frame.

10. The eccentric hinge according to claim 8, wherein the fixing rod comprises a first bending segment and a second bending segment; the first bending segment and the second bending segment are provided with through holes for fastening the fixing rod and the window sash.

* * * * *